US006318509B1

(12) United States Patent
Spieler et al.

(10) Patent No.: US 6,318,509 B1
(45) Date of Patent: Nov. 20, 2001

(54) FLEXIBLE ELEVATOR CAR DOME TO REDUCE NOISES FROM AIRFLOW

(75) Inventors: Jürg Spieler; Jürgen Kästle, both of Stans; Alex Oberer, Ennetbürgen, all of (CH)

(73) Assignee: Inventio HG, Hergiswil NW (CH)

( * ) Notice: Subject to any disclaimer, the term of this patent is extended or adjusted under 35 U.S.C. 154(b) by 0 days.

(21) Appl. No.: 09/501,867

(22) Filed: Feb. 10, 2000

(30) Foreign Application Priority Data

Feb. 17, 1999 (EP) ..... 99810142

(51) Int. Cl.[7] ..... B66B 11/02
(52) U.S. Cl. ..... 187/401
(58) Field of Search ..... 187/401, 402, 187/406, 414; 52/30; 135/88.13

(56) References Cited

U.S. PATENT DOCUMENTS

| | | | | |
|---|---|---|---|---|
| 777,558 | * | 12/1904 | Stifter | 187/377 |
| 5,099,866 | * | 3/1992 | Solis et al. | 135/105 |
| 5,220,979 | | 6/1993 | Matsuda . | |
| 5,582,456 | * | 12/1996 | Hammond | 135/88.07 X |
| 5,738,130 | * | 4/1998 | Thomas | 135/88.13 |
| 5,988,195 | * | 11/1999 | Kaestner et al. | 135/88.13 X |
| 6,047,792 | * | 4/2000 | Jin et al. | 187/401 |

FOREIGN PATENT DOCUMENTS

| | | | | |
|---|---|---|---|---|
| 2 280 662 | | 2/1995 | (GB) . | |
| 3-158377 A | * | 7/1991 | (JP) . | |
| 5-338996 A | * | 12/1993 | (JP) . | |
| 06305667 | | 11/1994 | (JP) . | |
| 6-329372 A | * | 11/1994 | (JP) . | |
| 8-34579 A | * | 2/1996 | (JP) . | |
| 10011838 | | 1/1999 | (JP) . | |
| 3-293281 A | * | 12/1991 | (JP) | 187/401 |
| 4-16486 A | * | 1/1992 | (JP) | 187/401 |
| 5-78064 A | * | 3/1993 | (JP) | 187/401 |
| 5-1178568 A | * | 7/1993 | (JP) | 187/401 |
| 5-246663 A | * | 9/1993 | (JP) | 187/401 |
| 5-286673 A | * | 11/1993 | (JP) | 187/401 |

* cited by examiner

*Primary Examiner*—Eileen D. Lillis
*Assistant Examiner*—Thuy V. Tran
(74) *Attorney, Agent, or Firm*—MacMillan, Sobanski & Todd, LLC

(57) ABSTRACT

An apparatus for reducing wind noises on elevator cars traveling at high speed includes domes with an aerodynamically favorable shape that are attached above the car roof and/or under the car floor. The domes are made of a flexible material attached over a supporting frame of rods or tubular air chambers. Closable openings in the dome walls permit evacuation of passengers and access to the car roof and the underside of the car.

18 Claims, 4 Drawing Sheets

FLEXIBLE ELEVATOR CAR DOME TO REDUCE NOISES FROM AIRFLOW

BACKGROUND OF THE INVENTION

The present invention relates to a device to reduce airflow noises on elevator cars travelling at high speed. The device is in the form of an aerodynamically favorably formed dome that is attached either on the car roof or under the car floor or in both positions.

An elevator car is part of an elevator installation, which consists essentially of the following components: an elevator hoistway with guiderails, the elevator car mentioned above with its car frame, a counterweight, the suspension ropes for car and counterweight, and a drive unit with traction sheave which drives these suspension ropes. High-speed cars are also connected on their underside to the counterweight by a compensating rope that runs over a pulley in the hoistway pit. The elevator car is elastically supported in the car frame, which hangs from the suspension ropes, is guided in the direction of travel by the guiderails acting on guiding elements, and is constructed robustly to allow for the stresses occurring in operation and when breakdowns occur.

Cars of elevator installations are usually constructed as aerodynamically unfavorable cuboid bodies with sharp edges and move in mostly narrow elevator hoistways. At travel speeds above about 4 m/s the occurrence of air eddies and flow separation cause noises that are unpleasant or even highly irritating. To reduce these noises, dome-like attachments of aerodynamically favorable shape are attached to high-speed elevator cars in one, or both, directions of travel with the objective of guiding the displaced air volume around the car body with as little eddying or separation as possible. The U.S. Pat. No. 5,220,979 discloses several solutions for attachments to elevator cars to improve airflow. All the solutions described there have the characteristics that on the same side as the entrance of the elevator car they have flat surfaces extending in the direction of the continuation of the car front wall downward, or downward and upward, and that their walls are constructed as robust plates or shaped parts.

The British patent document GB 2 280 662 also describes devices to improve the flow characteristics of elevator cars, the passenger car being built into a closed housing which is constructed in an aerodynamically favorable manner. As in the U.S. Pat. No. 5,220,979, the aerodynamically favorable housings shown in the patent document GB 2 280 662 also have on the same side as the entrance of the elevator car flat surfaces extending in the direction of the continuation of the car front wall upward or downward and the walls of these housings are constructed of robust, shaped parts.

Both the solutions mentioned have the disadvantages that the disclosed aerodynamically favorable attachments and housings are heavy and bulky components which require voluminous packing, are difficult to transport and install, and enormously increase the weight of the car to be moved by the elevator installation. Furthermore, manufacturing domes with multiaxially curved surfaces, as they are described in both documents, is very costly, particularly as the domes must be adapted to a large number of different car dimensions.

SUMMARY OF THE INVENTION

The present invention concerns aerodynamically favorable elevator car domes that can be manufactured inexpensively and flexibly, be packed into a small volume, are easy to transport and install, and have low mass.

According to the invention, this is achieved by such aerodynamically favorable car domes being made not from robust shaped parts but from a membranous, flexible, and foldable foil.

By comparison with known car attachments for improving airflow, car domes made in this way have the following important advantages:

No special machines, molds, or patterns are needed for their manufacture, as is the case with robust shaped parts. In view of the numerous different combinations of car dimensions, this results in decisive cost savings.

The folded flexible dome has only a small volume, is inexpensive to transport, and easy to install.

Thanks to the thin, membranous wall of the dome, the mass of the dome which has to be moved by the elevator installation in addition to the car remains minimal.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
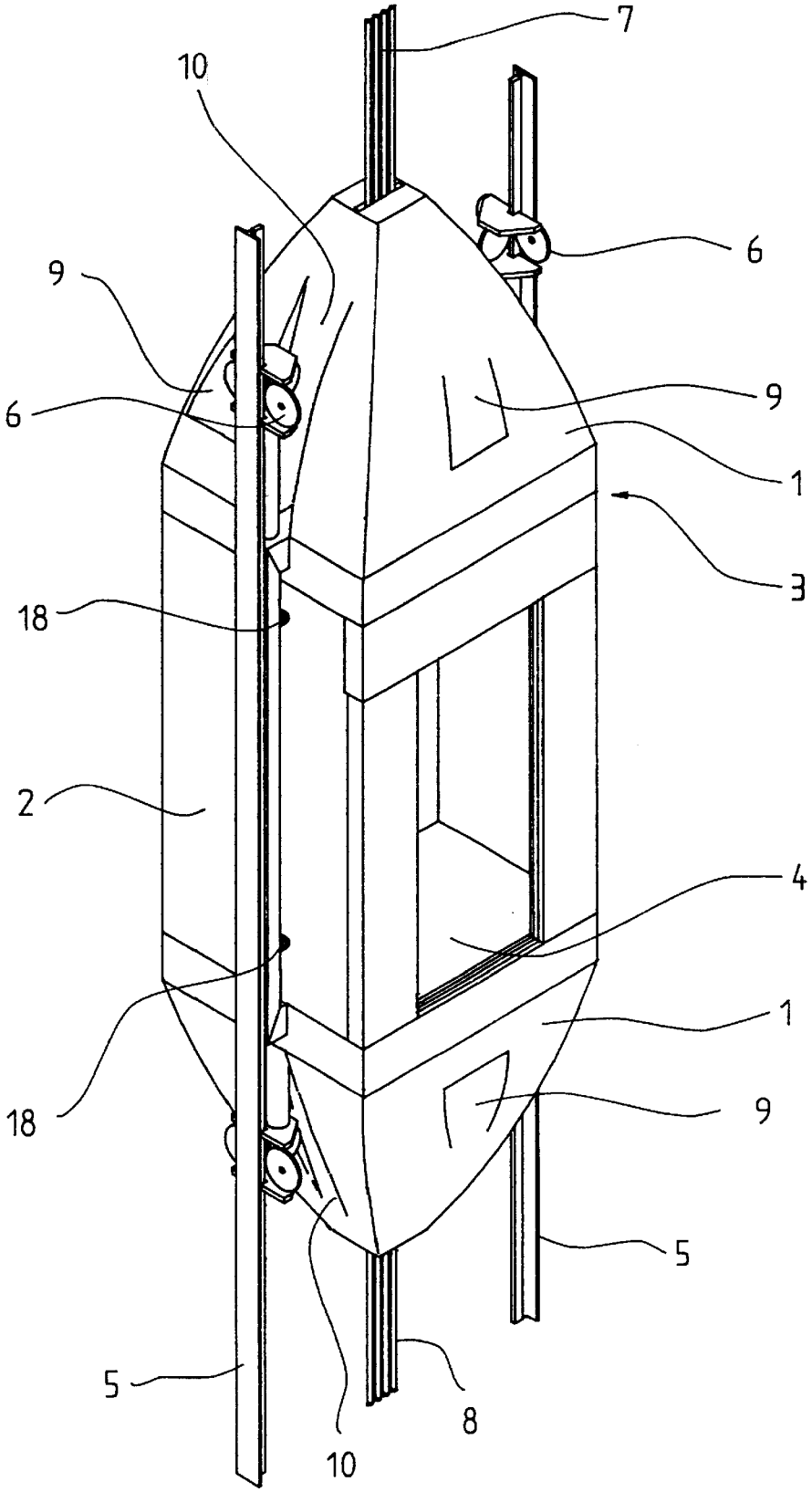
FIG. 1 is a perspective view of an elevator car with two aerodynamically favorable elevator car domes of membranous, flexible foil in accordance with the present invention.

FIG. 1 shows two elevator car domes 1 formed of a membranous, flexible foil material according to the present invention that are fastened on an elevator car 2 above the car roof 3 as well as under the car floor 4. The foil material is tear-resistant and consists preferably of plastic, e.g. PVC, of tent fabric, rubber, or similar materials. The elevator car 2 is guided on a pair of vertically extending guiderails 5 by guide rollers 6 and suspended between suspension ropes 7 and so-called compensating ropes 8 for travel in a hoistway (not shown). The drawing shows a preferred embodiment of the aerodynamically favorable dome 1, which resembles a slightly truncated pyramid, the surface of whose base corresponds to the horizontal outline of the car 2, and the side surfaces of which are curved to such an extent that vertical sections through their center form a close approximation to half an ellipse. The point of the dome 1 lies above or below the center of the car 2. The car dome 1 can be constructed of several partial surfaces or panels suitably cut and welded together. Aerodynamically favorable domes of a different shape can, of course, also be realized with the technique according to the present invention.

Formed in the side walls of the elevator car domes 1 are closable openings 9 which are constructed at suitable points in the membranous dome wall and permit passage for passengers being evacuated, as well as making the spaces above the car roof 3 and below the car floor 4 accessible for service work. Preferred means of closure are zip fasteners, but other types of closure such as Velcro fasteners, cord/eyelet fasteners, etc. can also be used. While the openings 9 are formed in at least one and can be formed in all of the side walls, recesses 10 are formed on both sides of the elevator car dome 1 facing the guiderails to make space and provide clearance for the guide rollers 6 and the safety devices (not shown) integrated into this area.

Figure 2:
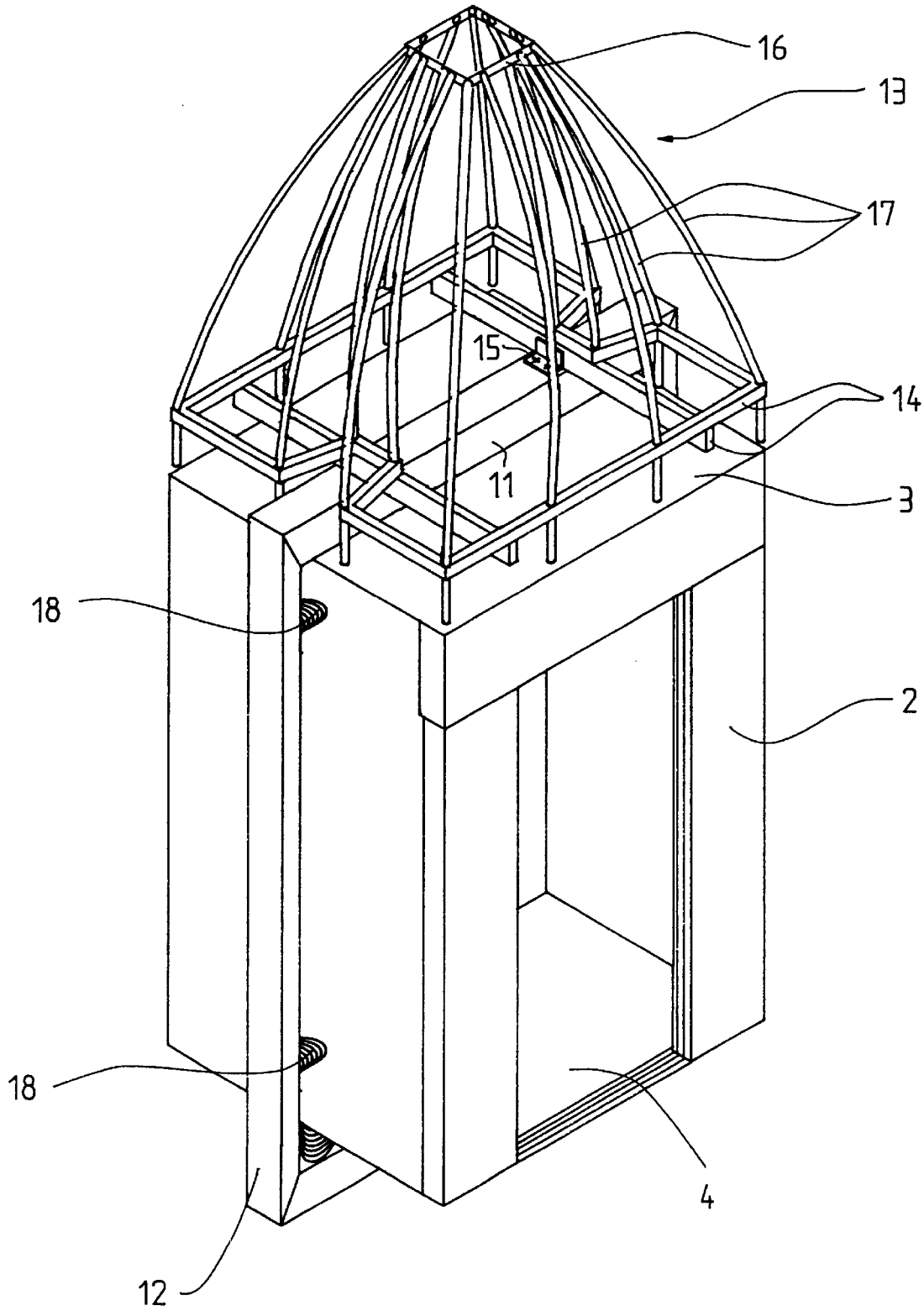
FIG. 2 is a perspective view of the elevator car shown in the FIG. 1 with an attached supporting construction of rod-shaped elements, which stiffen the wall of the dome.

FIG. 2 shows the car 2 with the lower dome 1 removed and the flexible foil removed from the upper dome 1 to expose a supporting construction or frame 13 fastened on an upper transverse yoke 11 of a car frame 12 which gives the necessary stiffness to the car dome flexible foil. Visible are a base frame 14 of the supporting frame 13, with fastening elements 15 for fastening the base frame to the car frame, a small upper rectangular frame 16 for the suspension ropes 7 to pass through, as well as a number of vertically oriented ribs in the form of supporting rods 17 arranged corresponding to the shape of the dome 1 and bent elliptically in the aerodynamically favorable shape. The positions of the rods 17 are determined in part by the recesses 10 in the sides, which are described above. The rods 17 each have one end attached to the base frame 14 and an opposite end attached to the upper frame 16.

During installation of the upper one of the domes 1 on the car 2, the base frame 14 is bolted tightly to the upper transverse yoke 11 of the car frame 12 mentioned above. Since the elevator car 2 is supported in this frame 12 by vibration-isolating elements 18, using this manner of fastening the dome 1 largely avoids transmission of structure borne noise between the dome and the car. Using bolted joints at suitable points makes it possible to dismantle the supporting construction 13 into parts of suitable size for transportation. On installations with high maximum speed and high noise reduction requirements, an additional identical dome 1 can be fastened facing the opposite way under the car floor 4 (as shown in FIG. 1) with the base frame of this second dome attached to the lower transverse yoke of the car frame 12. There, the opening in the small rectangular frame 16 is required for the passage of the compensating rope 8 mentioned above.

Figure 3:
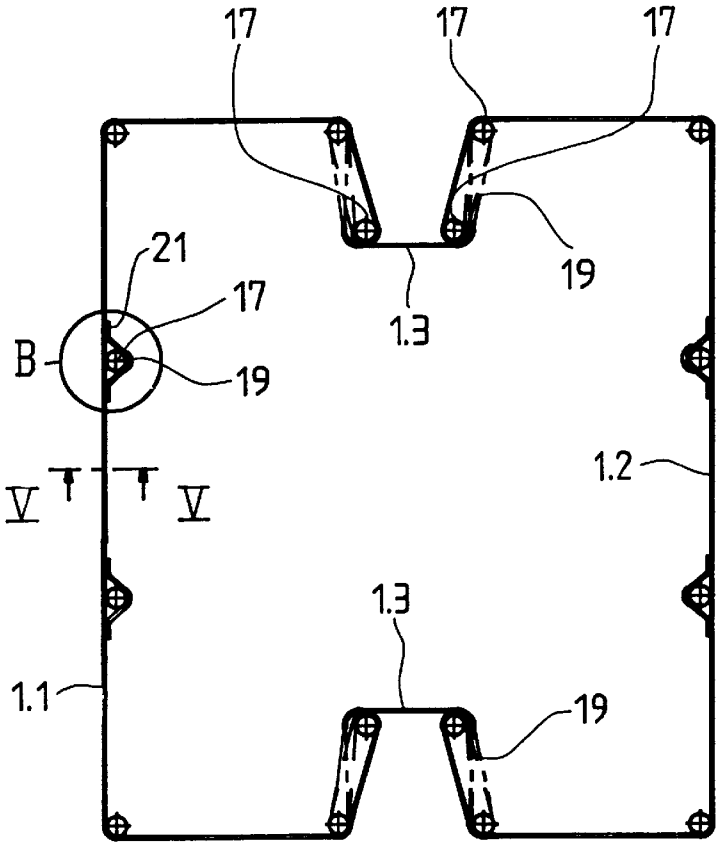
FIG. 3 is a horizontal section view through the elevator car dome according to the present invention.

FIG. 3 is a horizontal section through the flexible elevator car dome 1 showing the arrangement and fastening of the parts of the dome wall which are prefabricated by welding foil components or panels that have been cut to shape. Normally, the dome wall comprises a front panel 1.1, a rear panel 1.2, and two side panels 1.3 for closing the recesses 10 at the sides. It can also be seen in FIG. 3 how the dome wall parts mentioned above are fastened to the vertically oriented supporting rods 17 of the supporting frame 13, and tightened with the aid of eyelets fastened to their edges and cords 19.

Figure 4:
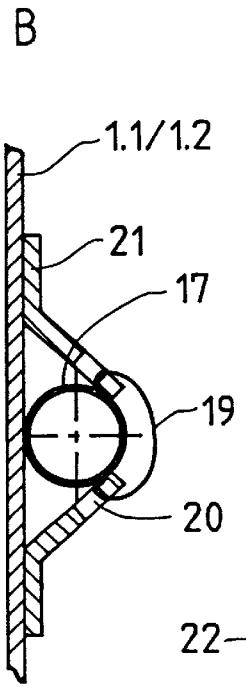
FIG. 4 is an enlarged portion "B" of the FIG. 3 showing the attachment of the membranous dome wall to the vertically oriented rods of the supporting construction.

FIG. 4 shows this fastening of the dome wall 1.1 to the rods 17 by means of eyelets 20 and the cords 19 in more detail. Fastening strips 21 are welded in the correct position during prefabrication of the dome parts and have the required number of eyelets 20.

Figure 5:
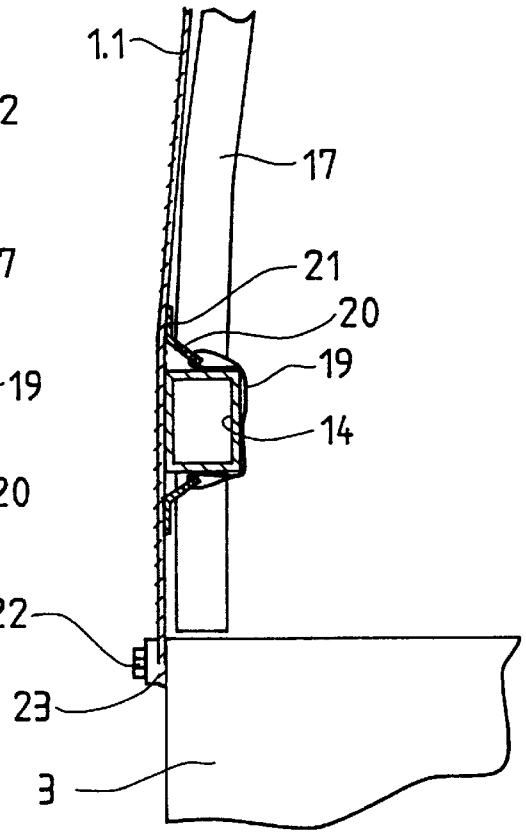
FIG. 5 is an enlarged fragmentary vertical section view taken along the line V—V in the FIG. 3 through part of the elevator car dome showing the fastening of the dome wall to the base frame of the supporting structure and to the car roof.

From FIG. 5 it can be seen how the flexible dome wall front panel 1.1 is fixed to the base frame 14 of the supporting frame 13 with the same eyelet/cord technique (fastening strips 21, eyelets 20 and cords 19) and to the car roof 3 with bolts 22 and a strip 23.

Figure 6:
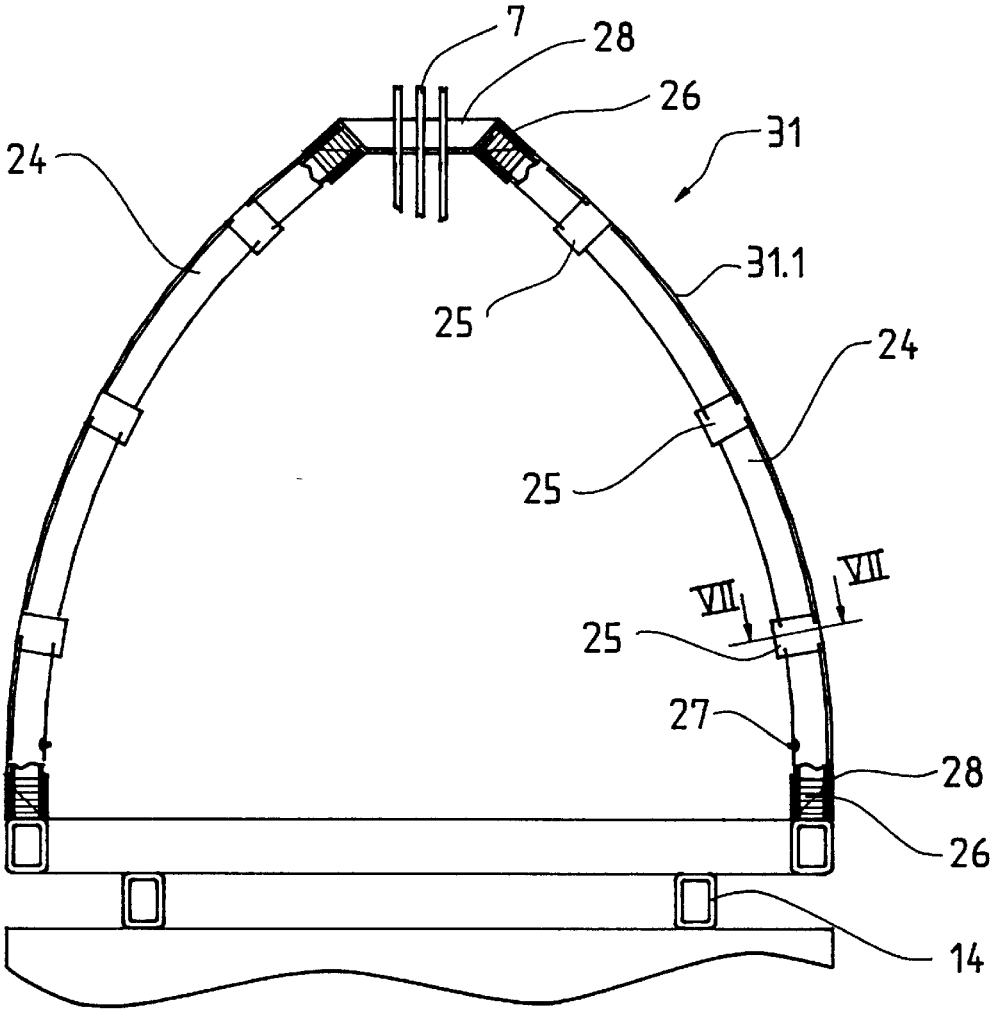
FIG. 6 is a vertical section view through an alternate embodiment elevator car dome according to the present invention that has tube-like air chambers built into the membranous dome wall as a supporting construction.
Figure 7:
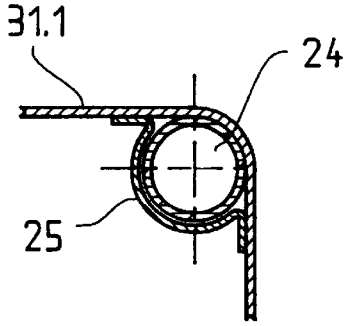
FIG. 7 is an enlarged cross-sectional view taken along the line VII—VII in the FIG. 7.

FIG. 6 shows schematically a further possible embodiment of a flexible car dome 31. Here, the required stiffness is not obtained by means of a supporting frame of bent rod ribs, but by ribs of inflatable air chambers 24 in the form of tubes which are fastened to the inside of the prefabricated dome. Fastening takes place by means of brackets 25 welded onto the inside wall of the dome, as can be seen in FIG. 7, a sectional view taken along the line VII—VII in the FIG. 6.

The spatial arrangement of these air chambers 24 corresponds approximately to that of the supporting rods 17 of the supporting frame 13 in FIG. 2. The shape of the dome 31, which is held erect by air pressure in the chambers 24, is derived from the shape of the dome panels which are cut and welded together to form a dome wall 31.1. The air chambers 24 consist preferably of fabric-reinforced, flexible, and airtight tubes, which are closed at both ends with stoppers 26, and have an inflation valve 27. Horizontally extending pieces of tube 28 are fastened to the base frame 14 and the upper rectangular frame 16 to receive the ends of the tubular air chambers 24 and force them into the desired initial direction.

The advantage of this alternate embodiment supporting frame over the supporting frame 13 with the rigid rods 17 is that the air chambers 24 can be built into the prefabricated flexible dome wall in the correct position. This dispenses with the need to fasten the dome wall to the supporting rods during installation. Moreover, with this technique, the dome wall can be made in one piece.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car dome having an aerodynamically favorable shape for reducing airflow noises when mounted on an elevator car travelling at high speed, the elevator car being supported in a frame having upper and lower transverse yokes adjacent respectively a roof and a floor of the elevator car comprising:

at least one panel of a flexible material;

a supporting frame having an aerodynamically favorable shape, said one panel being attached to said supporting frame to form a wall of the dome; and means for attaching said supporting frame and said one panel to one of the upper yoke adjacent the elevator car roof and the lower yoke adjacent the elevator car floor.

2. The dome according to claim 1 wherein said supporting frame includes a plurality of supporting rods extending generally vertically and being shaped in said aerodynamically favorable shape.

3. The dome according to claim 1 including at least one closable opening formed in said one panel.

4. The dome according to claim 3 wherein said closable opening is sized to permit a person to pass therethrough.

5. The dome according to claim 1 including a recess formed in said supporting frame and said one panel whereby when the dome is mounted on an elevator car having guide rollers, said recess proves clearance for the guide rollers.

6. The dome according to claim 1 including at least a pair of eyelets attached to said one panel and a cord cooperating with said eyelets to secure said one panel to said supporting frame.

7. The dome according to claim 1 wherein said supporting frame includes a plurality of vertically extending inflatable air chambers being shaped in said aerodynamically favorable shape when inflated.

8. The dome according to claim 7 wherein each of said air chambers is closed at opposite ends by a stopper.

9. The dome according to claim 7 including a plurality of brackets attached to said one panel for retaining said air chambers.

10. The dome according to claim 7 wherein said supporting frame includes a tubing piece attached to a lower end of each of said air chambers and another tubing piece attached to an upper end of each of said air chambers.

11. The dome according to claim 1 wherein said supporting frame is formed of a plurality of detachable parts sized for transportation to and assembly at an elevator site.

12. The dome according to claim 1 wherein said means for attaching includes at least one strip extending from said one panel and a bolt extending through said one strip for threaded engagement with the elevator car.

13. The dome according to claim 1 wherein said one panel and another panel of said flexible material are welded together and cooperate with the elevator car to cover said supporting frame.

14. An elevator car dome having an aerodynamically favorable shape for reducing airflow noises when mounted on an elevator car travelling at high speed, the elevator car being supported in a frame having upper and lower transverse yokes adjacent respectively a roof and a floor of the elevator car, comprising:

a wall of a flexible material;

a supporting frame having a slightly truncated pyramide shape including a plurality of vertically extending ribs, said wall being attached to said supporting frame to form an exterior surface of the dome; and means for attaching said supporting frame and said wall to one of the upper yoke adjacent the elevator car roof and the lower yoke adjacent the elevator car floor.

15. The dome according to claim 14 wherein said ribs are supporting rods.

16. The dome according to claim 14 wherein said ribs are tubular air chambers.

17. An elevator car comprising:

an elevator car having a roof and a floor, said elevator car being supported in a frame having upper and lower transverse yokes adjacent respectively said roof and said floor;

a pair of domes, one of said domes being mounted on top of said roof and another of said domes being mounted under said floor, each of said domes having an aerodynamically favorable shape for reducing airflow noises when said elevator car travels at high speed;

each said dome having at least one panel of a flexible and foldable foil material; and each said dome having a supporting frame with the aerodynamically favorable shape, said one panel being attached to said supporting frame to form an outer wall of said dome, one of said frames being attached to said upper transverse yoke adjacent said roof and another of said frames being attached to said lower transverse yoke adjacent said floor.

18. The elevator car according to claim 17 wherein said one panel and another associated panel of said flexible material are welded together and cooperate with the elevator car to cover said respective supporting frame.

* * * * *